US006474198B2

(12) United States Patent
Lowther

(10) Patent No.: US 6,474,198 B2
(45) **Date of Patent: *Nov. 5, 2002**

(54) SLIDE HAMMER

(75) Inventor: John K. Lowther, Aurora, CO (US)

(73) Assignee: Slide Sledge Technology, Inc., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/013,411

(22) Filed: Dec. 7, 2001

(65) Prior Publication Data

US 2002/0046631 A1 Apr. 25, 2002

Related U.S. Application Data

(63) Continuation-in-part of application No. 09/677,497, filed on Oct. 2, 2000, now Pat. No. 6,349,618, which is a continuation-in-part of application No. 09/281,007, filed on Mar. 30, 1999, now Pat. No. 6,125,719.

(51) Int. Cl.[7] ..... B25D 1/00
(52) U.S. Cl. ..... 81/27; 173/90
(58) Field of Search ..... 81/27, 463; 173/90, 173/91

(56) References Cited

U.S. PATENT DOCUMENTS

| | | | | | |
|---|---|---|---|---|---|
| 839,246 | A | | 12/1906 | Williams | 173/90 |
| 2,475,041 | A | | 7/1949 | Mattson | 173/132 |
| 3,036,482 | A | * | 5/1962 | Kenwrothy et al. | 173/90 |
| 3,117,378 | A | * | 1/1964 | Bowen | 33/293 |
| 3,568,657 | A | * | 3/1971 | Gue | 81/27 |
| 4,241,795 | A | | 12/1980 | Landry, Jr. | 173/90 |
| 4,470,440 | A | | 9/1984 | Thor | 144/193 |
| 5,085,281 | A | | 2/1992 | Selly | 173/91 |
| 5,370,192 | A | | 12/1994 | Evinger | 173/90 |
| 5,495,878 | A | * | 3/1996 | McKenen, Jr. | 144/195.5 |
| 5,699,864 | A | * | 12/1997 | Dvorak et al. | 173/91 |
| 5,797,300 | A | | 8/1998 | Fairbanks | 81/60 |
| 5,875,951 | A | * | 3/1999 | Ingle et al. | 227/147 |
| 5,878,822 | A | | 3/1999 | Roy | 173/90 |
| 6,109,365 | A | | 8/2000 | Lamoureux et al. | 173/90 |
| 6,125,719 | A | | 10/2000 | Lowther et al. | 81/27 |

* cited by examiner

*Primary Examiner*—James G. Smith
*Assistant Examiner*—Hadi Shakeri
(74) *Attorney, Agent, or Firm*—Sheridan Ross P.C.

(57) ABSTRACT

A slide hammer includes three major components, namely, a guide sleeve, a plunger and an impact head. The plunger is inserted within the guide sleeve. The impact head is secured within the distal end of the guide sleeve, and has a portion which protrudes from the guide sleeve distal end. The impact head is able to freely slide within a segmented portion of the guide sleeve distal end. The plunger is slid within the guide sleeve at a selected velocity in order to contact the portion of the impact head slidably secured within the guide sleeve. The force of the plunger striking the impact head is transmitted through the impact head to a targeted object in contact with the protruding portion of the impact head. The impact head may be fitted with various types of tips. Each of the tips has particular advantages in applying force to a targeted object.

5 Claims, 8 Drawing Sheets

SLIDE HAMMER

CROSS REFERENCE TO RELATED APPLICATIONS

This application is a continuation-in-part application of U.S. Ser. No. 09/677,497, filed Oct. 2, 2000, entitled "SLIDE HAMMER" (now U.S. Pat. No. 6,349,618), which is a Continuation-in-Part application of U.S. Ser. No. 09/281,007, filed Mar. 30, 1999, entitled "SLIDE HAMMER", now U.S. Pat. No. 6,125,719.

TECHNICAL FIELD

This invention relates to a device which transfers the force of an impact to a targeted object and, more particularly, to a slide hammer which transfers the force of an impact to a targeted object.

BACKGROUND ART

It is known to use various combinations of chisels and hammers in order to impart a force upon a targeted object. In the automotive repair industry, it is often necessary to reshape and straighten vehicle body frames which have been damaged. Various forms of frame straightening machines are available for such purposes. However, even with the availability of such machines, it is still necessary in most cases to apply manual force to the frame in order to achieve the exact type of reshaping necessary to straighten the frame. Particularly for hard-to-reach locations on the vehicle frame, pneumatic or hydraulic machines are simply not able to be positioned in a manner to provide force against the targeted frame location. Also, for intricate reshaping of smaller frame members, machines are unsuitable. Thus, the straightening of a vehicle body frame still requires a considerable amount of manual labor.

One disadvantage of using a hammer and chisel is that the hammer and chisel have to be firmly gripped. Because metal to metal contact is made between the frame and the chisel, most of the force of the impact is transmitted back through the user's hands and arms. This force transmitted back through the hands and arms of a person can cause great pain and discomfort, as well as to cause premature fatigue. Because the hammer has to be swung with great force, the hammer itself can become a danger, particularly in hammering out those hard-to-reach locations on the frame. These and other known hazards make the use of a chisel and hammer undesirable.

Therefore, a need exists for a device which can be safely and easily manipulated by a user for applying a desired amount of force to a targeted object. A need also exists for a hammering device which allows a user to vary the amount of force applied by the device without having to substantially change the user's physical efforts in manipulating the device.

It is one object of this invention to provide a slide hammer device which is able to transfer the force of an impact to a specific targeted object. It is another object of this invention to provide a slide hammer device which minimizes the reaction force which is transmitted back through the user's hands and arms. It is yet another object of this invention to provide increased safety with a hammering device. It is yet another object of this invention to provide a hammering device which has removable and varying tip configurations in order to further control the type of force applied to the targeted object. These objects and others will be explained more fully below as they apply to the slide hammer device of this invention.

DISCLOSURE OF THE INVENTION

In its simplest form, the slide hammer of this invention is a hammering device which allows the force of an impact to be transferred to a targeted object. The apparatus has three major components, namely, a guide sleeve, a plunger, and an impact head. The plunger is inserted within the guide sleeve. The impact head is secured within the distal end of the guide sleeve, and has a portion which protrudes from the guide sleeve distal end. The impact head is able to freely slide within a specified portion of the guide sleeve distal end. The plunger is slid within the guide sleeve and is able to make contact with the portion of the impact head slidably secured within the guide sleeve. The force of the plunger moving striking the impact head is transmitted through the impact head to a targeted object contacted by the impact head, such as a vehicle frame member. The impact head may be fitted with various types of tips. The particular tip chosen is based upon the type of force which is to be applied upon the targeted object. The exterior dimension of the plunger and the channel or opening in the guide sleeve are sized for a relatively close tolerance fit which ensures a smooth sliding movement of the plunger within the guide sleeve. The portion of the impact head secured within the guide sleeve distal end is also sized so that it maintains a relatively precise sliding movement within the guide sleeve. Optionally, various sized weights may be added to the plunger in order to increase or decrease the amount of force which is transmitted from the plunger to the impact head. A removable handle may be mounted to the guide sleeve in order to further reduce the shock of the impact which is transmitted back through the user's hands and arms, and also to allow the device to be more easily gripped during use. Also, a removable support may be used when the device is used to apply force to an object on the ground, such as concrete or asphalt.

The use of the guide sleeve to guide the plunger greatly increases the accuracy at which a force is applied and to a targeted object. Not only can the angle at which the force is applied be better controlled, but also the magnitude of the applied force as well. The guide sleeve acts as an alignment means for directing the force at a desired angle. Since the plunger travels along this aligned path, the angle at which the force is applied to a targeted object is very accurate. With a hammer and chisel, it is much more difficult to maintain this aligned path between the chisel axis and the angle at which the hammer strikes the chisel head; therefore, the angle at which force is applied to a targeted object is more inconsistent. In terms of force magnitude, the plunger may be slid within the guide sleeve at the appropriate velocity to increase or decrease the force transmitted through the impact head. The use of the guide sleeve in conjunction with the plunger also makes the application of force safer since there is no possibility that the plunger will become disengaged from or otherwise slip away from the impact head during impact. Since the plunger may be slid within the guide sleeve as opposed to being independently lifted or carried throughout a striking motion, the user must only overcome the slight friction between the guide sleeve and the plunger to move the plunger for contact with the impact head. The plunger may be lubricated as necessary to further reduce the amount of effort required to slide the plunger within the guide sleeve. The removable weights attached to the plunger can allow one to further vary the force applied. Additionally, the guide sleeve and plunger may be made longer or shorter depending upon the application and the amount of force to be applied to the targeted object. Because the impact head may be fitted with removable tips, the slide hammer is adaptable for use in many applications.

The use of the device results in less force being transmitted back through the hands and arms of a user. When the plunger achieves the desired velocity within the guide sleeve, the user's hand need not be gripped tightly around the proximal end of the plunger which, in turn, reduces the amount of force transmitted back through that hand. As discussed above with respect to a standard hammer and chisel, a hammer must always be tightly gripped during impact against the chisel which, in turn, results in much greater force being transmitted back through the hand. Also, since the impact head is able to slide along a specified length within the guide sleeve, the guide sleeve itself may recoil and absorb the retransmitted impact force which further reduces the shock experienced by the user's hand which grips the guide sleeve. In general, the sliding engagement of the impact head and the plunger within the guide sleeve combines to enhance the shock absorption characteristics of the slide hammer.

Since the impact head is able to slide with minimal resistance within the specified portion of the guide sleeve, the full impact of the moving plunger may be transmitted to the impact head which, in turn, helps to ensure that an adequate force is applied to the targeted object.

In addition to the above described advantages of the slide hammer, the slide hammer also includes a number of varying tip configurations which can be used to apply force upon a targeted object. The tip configurations are designed specifically for applying force for different types of situations. Thus, the removable tips enable the slide hammer to be used as a universal means for applying force to a targeted object.

These and other advantages will become more apparent by a review of the following figures, in conjunction with the detailed description.

BEST MODE FOR CARRYING OUT THE INVENTION

Figures 1, 2, 3:
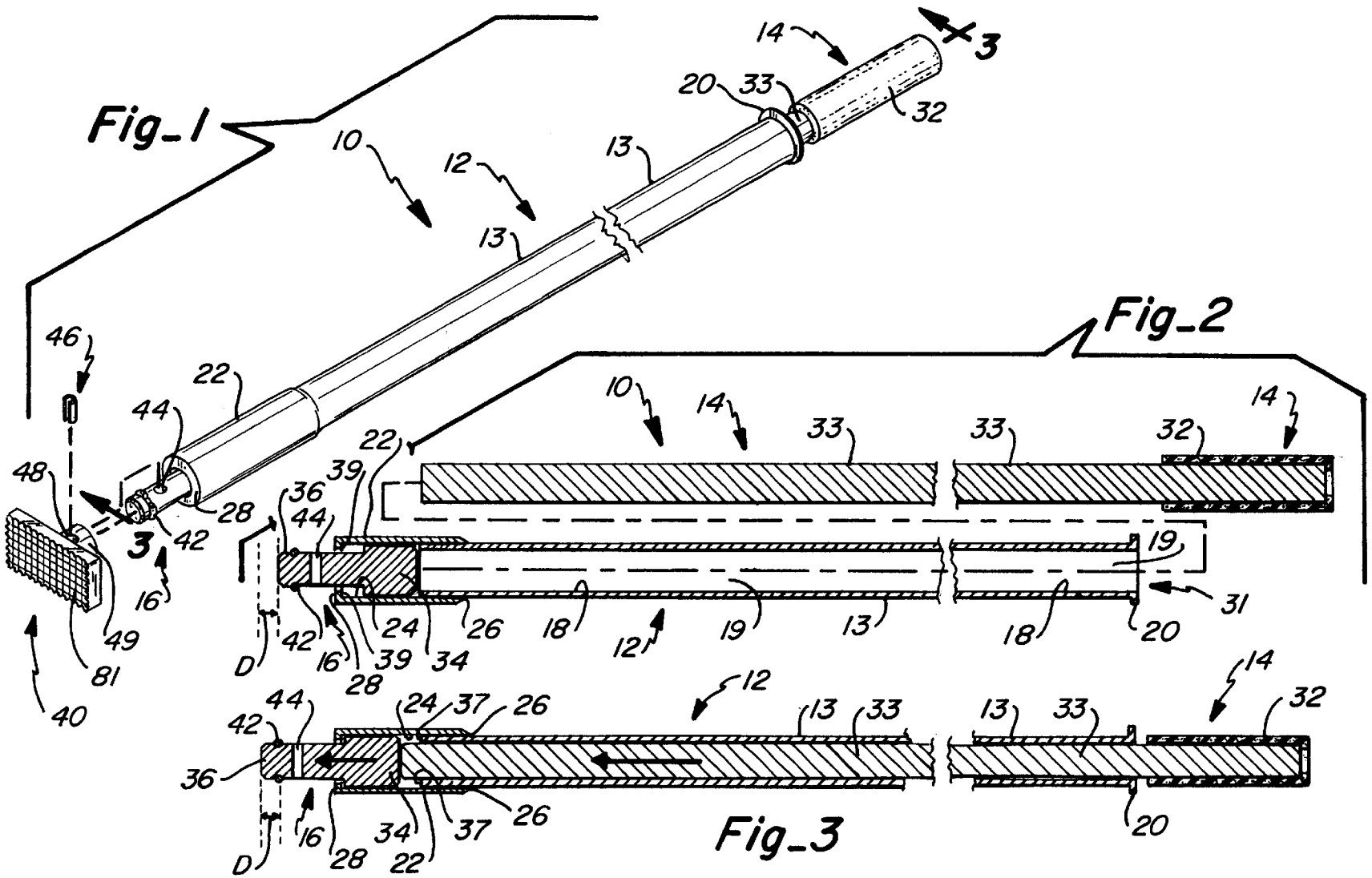
FIG. 1 is a partially exploded perspective view of the slide hammer of this invention.
FIG. 2 is a partially exploded vertical section, taken along line 3—3 of FIG. 1.
FIG. 3 is a vertical section, taken along line 3—3 of FIG. 1.

As shown in FIGS. 1–3, the slide hammer 10 includes three major components, namely, a guide sleeve 12, a plunger 14 that is slidably engaged within said guide sleeve, and an impact head 16 which is slidably secured within the distal end of the guide sleeve 12. The guide sleeve 12 is preferably of a cylindrical shape, and has a main guide sleeve section 13 and a corresponding inner cylindrical surface 18 forming a longitudinal passageway 19. A flange 20 is formed at the proximal end of the guide sleeve. The guide sleeve 12 further includes an impact head receiving section 22. As shown in the vertical sections of FIGS. 2 and 3, receiving section 22 has an inner cylindrical surface 24 which is of a slightly larger diameter than inner surface 18. Receiving section 22 may simply be a larger sized cylinder pipe member which overlaps with main guide sleeve section 13 at welded joint or overlap area 26. The distal end of head receiving section 22 has a washer or distal stop 28 welded thereto. Alternatively, the distal end of the main guide sleeve section 13 may have external threads which mate with internal threads formed on the proximal end of receiving section 22. Thus, receiving section 22 can be removed from the main guide sleeve section 13. Periodically, it may be necessary to clean the interior of receiving section 22. Furthermore, any damage to the receiving section 22 or to the impact head 16 can be remedied by replacing these components as opposed to replacing the entire device.

Plunger 14 is a solid and cylindrical shaped member including a main shaft or rod 33. A gripping means or handle 32 may be attached to the proximal end of plunger 14. The distal end of plunger 14 is inserted within the opening 31 and into passageway 19 of guide sleeve 12. Plunger 14 is slidable within passageway 19 of guide sleeve 12 to make contact with impact head 16. The extent to which plunger 14 is inserted within passageway 19 of guide sleeve 12 may be limited by contact of the handle 32 against flange 20. The distal end of plunger 14 must be able to be inserted far enough within guide sleeve 12 to make contact with impact head 16. As also shown in FIGS. 1–3, impact head 16 includes a slide portion 34 which is slidable within guide sleeve 12 along inner surface 24, and an impact extension 36 which protrudes through washer/stop 28. Impact head 16 may simply be a solid member having two distinct cylindrical sections of differing diameters, namely, impact extension 36 being smaller and slide portion 34 being larger. As shown in FIGS. 2 and 3, impact head 16 is free to slide along inner surface 24 and in the open space between the distal end 37 of main section 13, and the inner surface 39 of washer/stop 28. Thus, the distal end 37 of main section 13 forms a proximal stop to limit the proximal travel of impact head 16 while distal stop 28 limits the distal travel. The amount of displacement or movement within receiving section 22 by impact head 16 is shown as distance D in FIGS. 2 and 3. This distance D may be adjusted as desired by either increasing or decreasing the length of slide portion 34, or by increasing or decreasing the length of head receiving section 22. Additionally, while the preferred embodiment shows the guide sleeve 12 and plunger 14 being of certain relative lengths, it shall also be understood that the lengths of these members may also be increased or decreased as desired.

Depending upon the type of impact or force to be applied to a targeted object, a number of different types of interchangeable tips 40 may be employed. FIG. 1 and FIGS. 7–16 illustrate examples of interchangeable tips 40. Each of the interchangeable tips 40 include a bore or channel 47 formed in a receiving section 49 to receive impact extension 36. Interchangeable tips 40 may be secured to impact section 36 in any number of well-known means. For example, a radial groove may be formed in impact extension 36 and a biased split ring 42 may be secured within the groove. Alternatively, or in conjunction with the use of split ring 42, a hole 44 may be drilled through impact extension 36. A roll or cotter pin 46 may then be used to secure the tip 40. If such a pin 46 is used, a corresponding hole 48 may be drilled in receiving section 49 of the tip 40.

Split ring 42, in the alternative, can represent an o-ring which is secured within the radial groove. The o-ring can be sized to provide a friction fit between the impact extension 36 and the interior surface of the receiving section 49. Furthermore, the cotter pin 46 could also be used in conjunction with the o-ring in order to secure the tip 40. Those skilled in the art can envision other ways in which the tips 40 may be attached to the impact extension 36.

Figure 4:
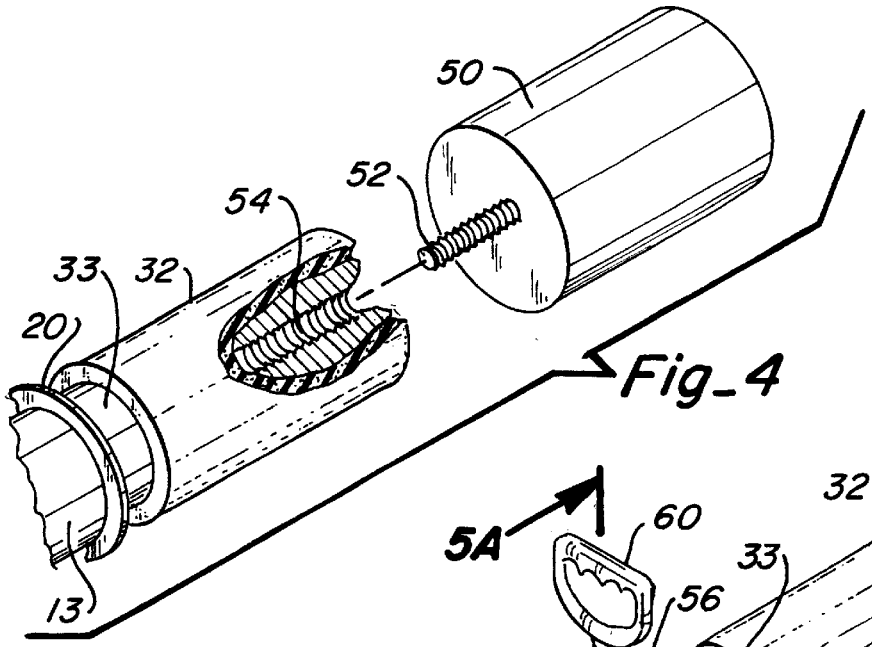
FIG. 4 is an enlarged fragmentary exploded perspective view illustrating a removable weight attached to the proximal end of the plunger.

Now referring to FIG. 4, a weight 50 may removably attach to the proximal end of plunger 14 in order to vary the amount of force which is applied to a targeted object. As shown, weight 50 may simply be another solid, cylindrical member with a protruding threaded screw 52 which is screwed into a corresponding threaded well 54 formed in the proximal end of plunger 14. Alternatively, the proximal end of the plunger 14 may have a threaded screw 52, and weight 50 may have a corresponding threaded well for receiving the screw. The specific mass of weight 50 may be adjusted to modify the force to be applied.

Figure 5:
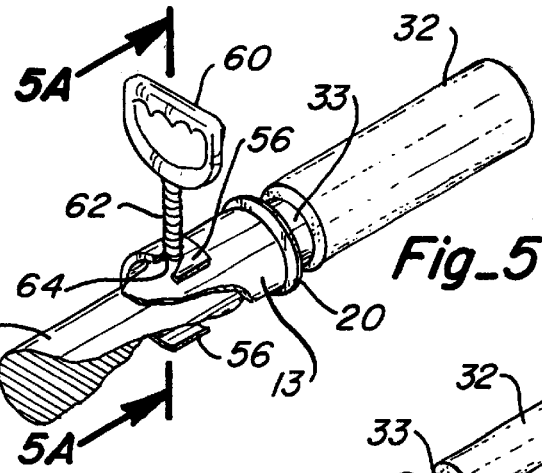
FIG. 5 is a fragmentary perspective view of an integral collar and extending handle which may attach to the guide sleeve to further assist a user in holding the slide hammer during use.
Figure 5A:
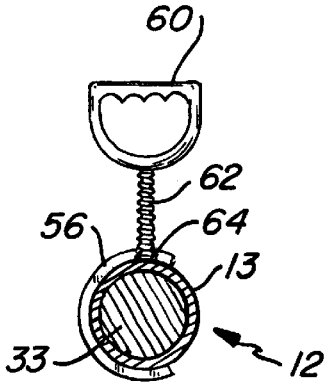
FIG. 5A is a vertical section, taken along line 5A—5A of FIG. 5.

Now referring to FIGS. 5 and 5A, means may be provided on guide sleeve 12 for holding or securing the guide sleeve during use, and further to dampen or reduce the amount of shock that is transmitted to the user. As shown, a collar 56 is placed over the guide sleeve 12, and a handle 60 with a protruding threaded screw or nut 62 is received within a threaded well 64 which extends completely through collar 56. The leading or distal tip of threaded nut 62 contacts the guide sleeve 12 to secure the handle 60 in place. The collar 56 may be placed at any point along the length of the guide sleeve 12.

Figure 6:
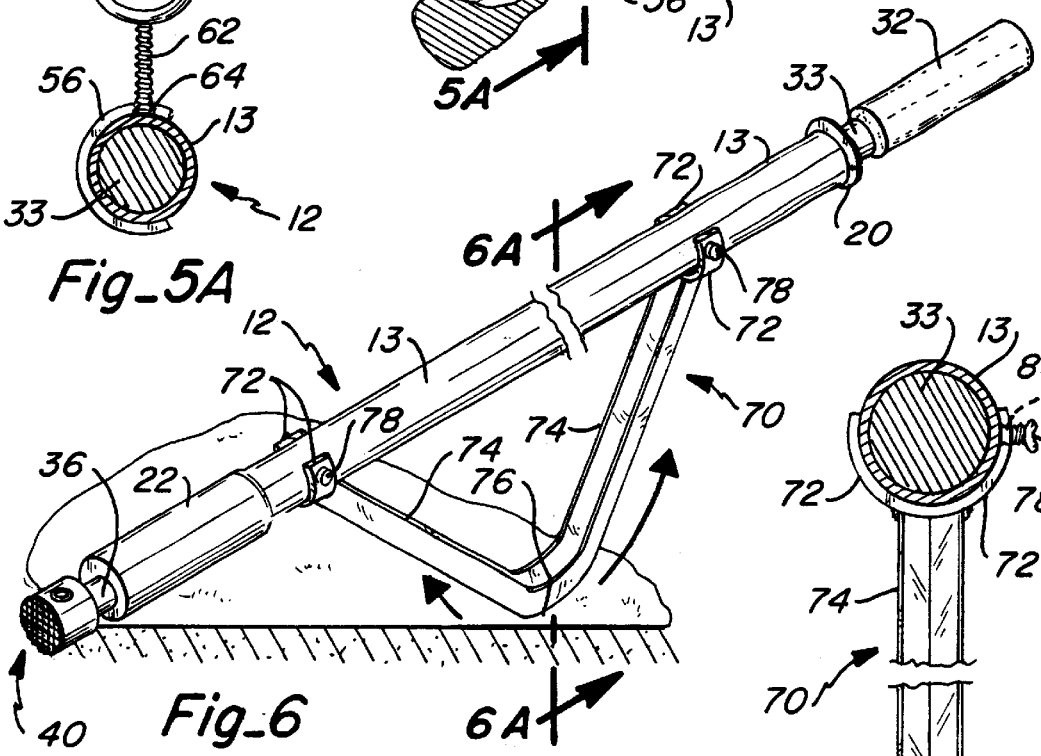
FIG. 6 is a perspective view of the slide hammer and a ground support accessory for supporting the slide hammer when used to contact an object on the surface of the ground.
Figure 6A:
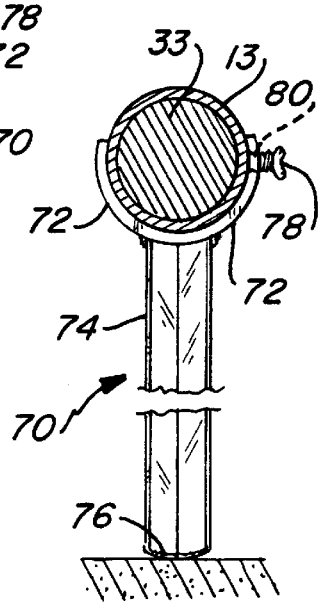
FIG. 6A is an enlarged vertical section, taken along line 6A—6A of FIG. 6.
Figure 7:
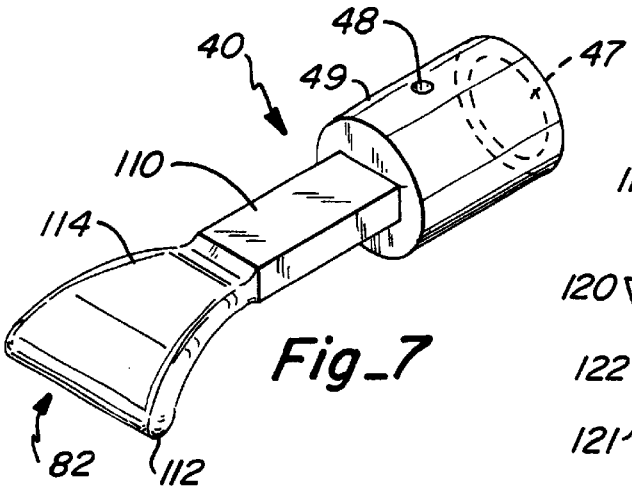
FIGS. 7–16 are enlarged perspective views of the various types of tips which may be used with slide hammer.
Figure 8:
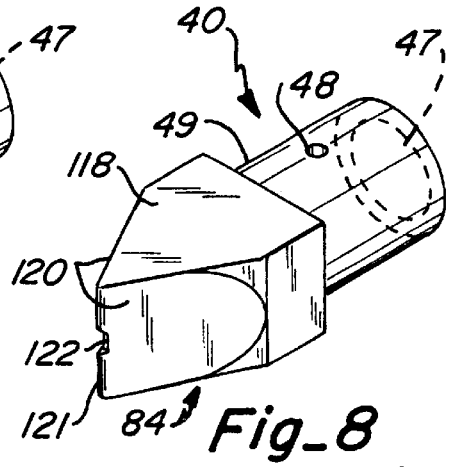
Fig 8 (PRIOR ART)
Figure 9:
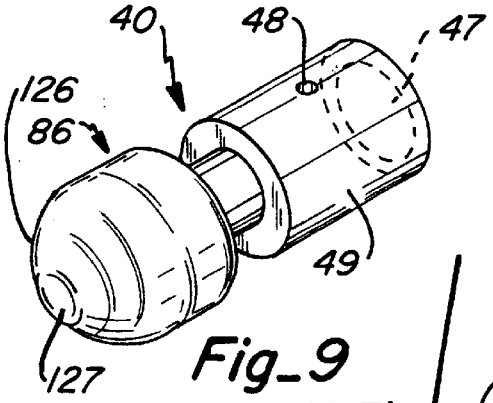
Fig 9 (PRIOR ART)
Figure 10:
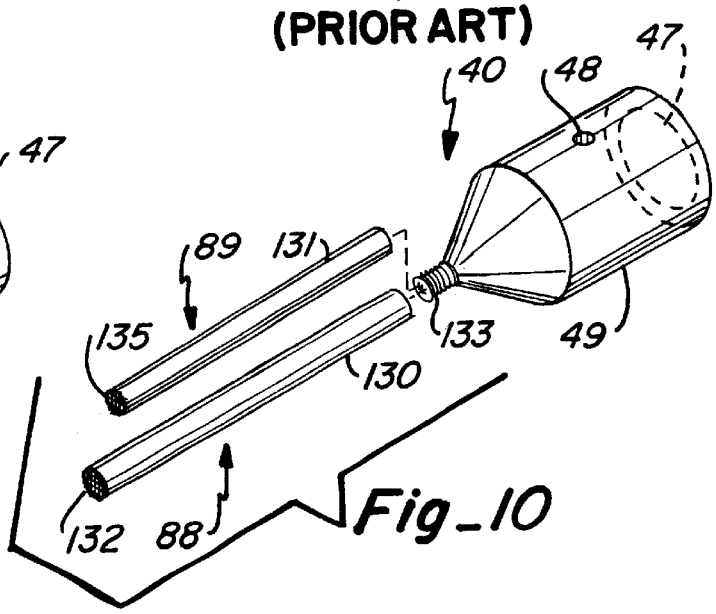
Figure 11:
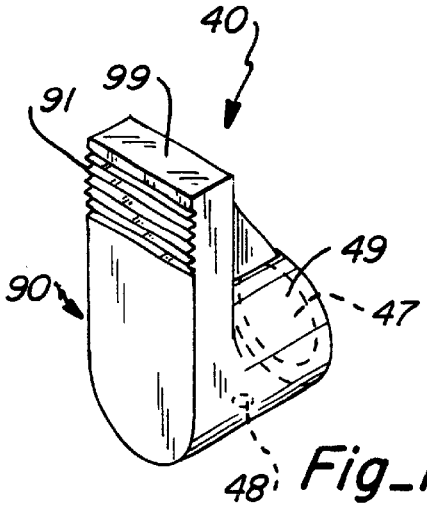
Fig 11 (PRIOR ART)
Figure 12:
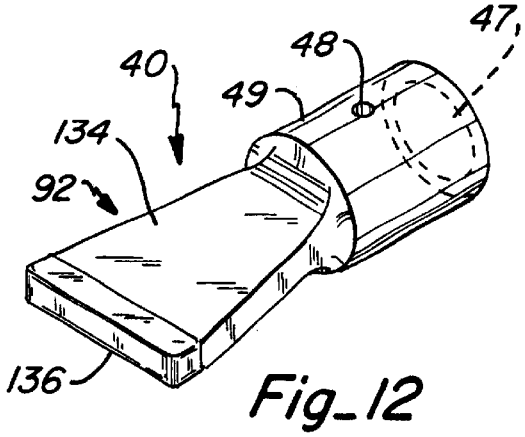
Figure 13:
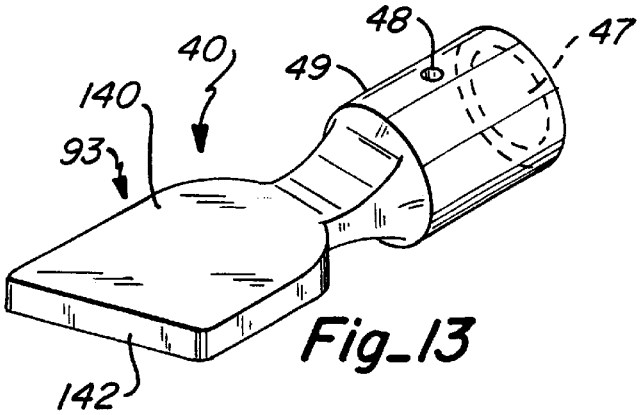
Figure 14:
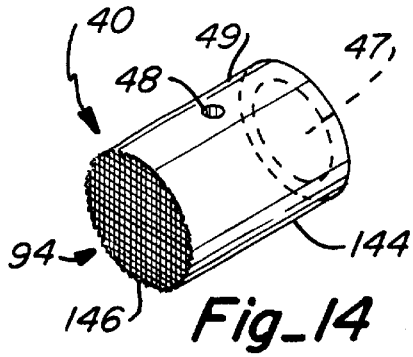
Fig 14 (PRIOR ART)
Figure 15:
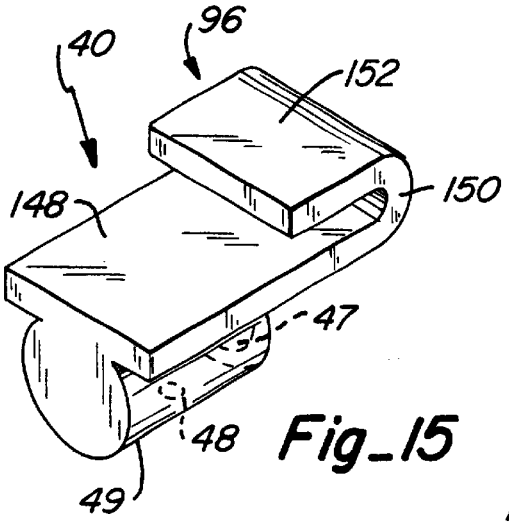

In some applications, it may be necessary to apply a force to an object which is on the surface of the ground. In such applications, it is advantageous to have a support which helps in steadying the guide sleeve 12. Accordingly, FIG. 6 illustrates an accessory in the form of a support 70 which may be used in such circumstances. Support 70 may include a pair of spaced collars 72 interconnected by a curved brace 74. A pivot or contact point 76 is formed approximately midway between collars 72. This pivot/contact point 76 is placed on the ground. Collars 72 may simply be U-shaped members, as shown in FIG. 6A. A tightening nut 78 is received in a threaded well 80 formed in collars 72. The leading or distal tip of tightening nut 78 contacts guide sleeve 12 to secure the brace 70 in place. Although a pair of collars are shown, it shall be understood that only one collar is necessary for support 70. Accordingly, brace 74 could simply be a straight member which extends from collar 72 and has a distal end which contacts the ground;

FIGS. 1 and 7–16 illustrate some examples of the types of tips which may be used with the slide hammer of this invention. As discussed above, common to each of these tips 40 are the corresponding receiving sections 49 with bores or channels 47 for receiving impact extension 36. Each of these tips may also include the holes 48 for receiving the pin 46;

FIG. 1 illustrates a rectangular shaped tip 81 having a waffle-like contacting surface;

FIG. 7 illustrates a curved tip 82;

FIG. 8 illustrates a chisel-type tip 84;

FIG. 9 illustrates a rubber, mallet-type tip 86;

FIG. 10 illustrates an interchangeable rod-like tip 88 and another interchangeable rod-like tip 89 of a different length and diameter;

FIG. 11 illustrates an enlarged tip 90 with grooves 91 located on a transversely extending extension or flange 99;

FIG. 12 illustrates a blunted, chisel-type tip 92;

FIG. 13 illustrates a spatula-shaped tip 93;

FIG. 14 illustrates a circular waffle-type tip 94;

FIG. 15 illustrates a hook-type tip 96; and

Figure 16:
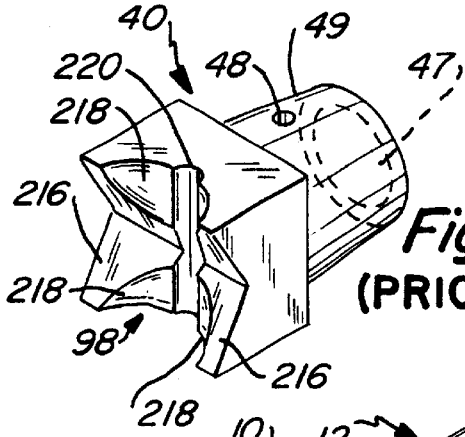
Fig 16 (PRIOR ART)

FIG. 16 illustrates a tip 98 which may be used to apply force in a multitude of angles based upon the various shaped impact surfaces. Some of these disclosed tips are similar to tips which may found in commercially available hydraulic rain sets, such as a Port-A-Power™ hydraulic ram sets. Specifically, the removable tips shown in FIGS. 8, 9, 11, 14 and 16 may be found in commercially available ram sets.

Also, each of the foregoing described tips could be fitted with a ball and socket-type connection (not shown) at receiving sections 49. These rotatable connections would further allow the slide hammer to be positioned in hard-to-reach locations in order to apply a force at an exact desired angle.

In operation, the tip 40 is placed against the targeted object. Preferably, the impact head is placed in the retracted position of FIG. 2, or at least in a partially retracted position. The slide hammer is then positioned at the desired angle with respect to the targeted object. The plunger is then moved at the desire speed within the guide sleeve to contact the impact head. The greater the velocity, the greater the force applied through the impact head to the targeted object. When the force of the impact head is transferred to the targeted object, in accordance with basic physics principles, an equal and opposite reaction will be transmitted back through the impact head. Some of this force will be transmitted back through the guide sleeve, but since the guide sleeve is not rigidly connected to the impact head, a much lesser force will be transmitted through the guide sleeve. Thus, the hand holding the guide sleeve should not experience undue shock. The majority of the recoil or reaction force will be transmitted back through the plunger. Because the user's hand does not need to firmly grasp the plunger, less force will be transmitted back through the user's hand and arm which manipulates the plunger. Additionally, the handle 32 will absorb some of the recoil. In those circumstances when the slide hammer is in use and when the handle 32 is held at a higher elevation than the distal end 30, it may not be necessary to continue to grasp the plunger after its sliding movement within the guide sleeve 12 has reached the desire velocity. Accordingly, no shock or recoil is transmitted through the user's hand or arm. Depending upon the length of the guide sleeve, however, it may be necessary to monitor the recoil of the plunger so it does not completely exit the guide sleeve or otherwise contact the user.

Even if the impact head 16 is in the full extended position of FIG. 3 when the plunger makes contact with the impact head, minimal recoil or reaction forces will be generated through the guide sleeve. Additionally, the vibrations caused by the impact with the targeted object will cause at least some inherent sliding movement of the impact head in the proximal direction which, in turn, will help to dissipate or dampen the recoil. Therefore, regardless of whether the slide hammer is in the fully retracted or extended position, the slide hammer is effective in allowing a force to be projected onto a targeted object without sacrificing safety or comfort for the user.

Figure 17:
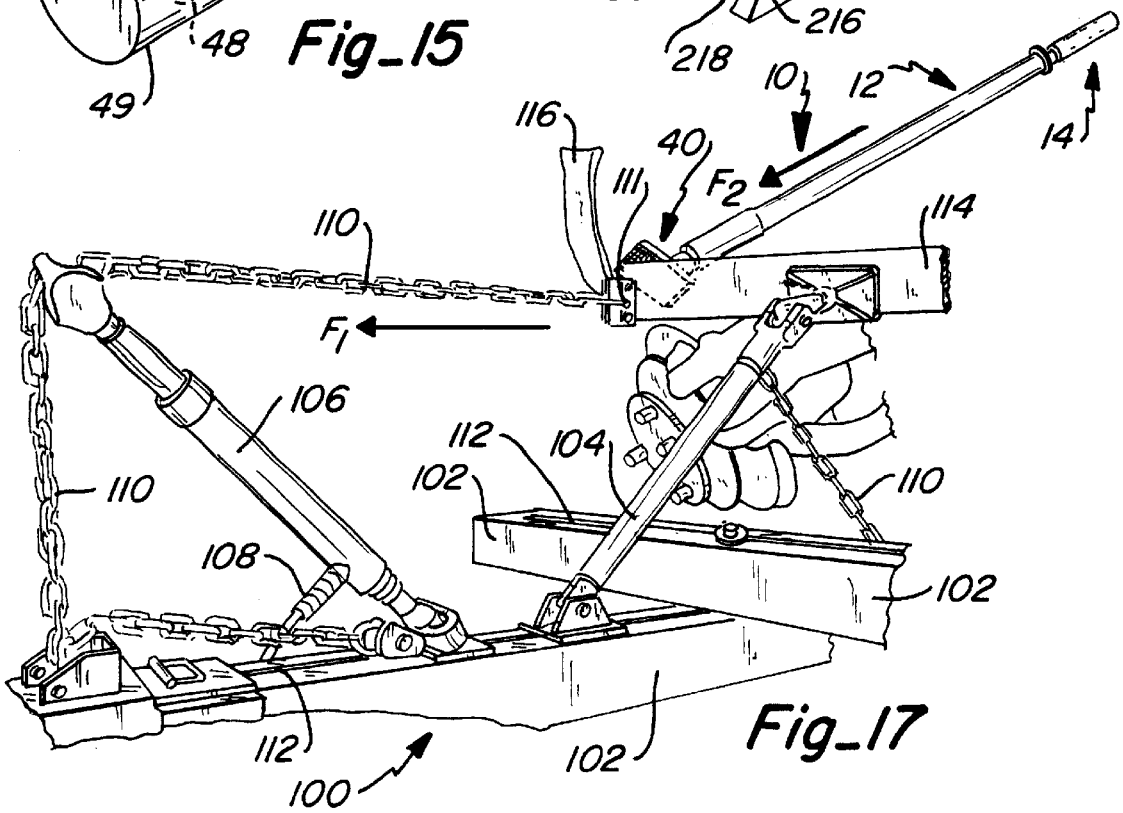
FIG. 17 is a fragmentary perspective view of a vehicle mounted to a frame pulling machine, and the slide hammer of this invention positioned to apply a force against the vehicle frame.

FIG. 17 illustrates how the slide hammer 10 of this invention may be used to apply a force to the portion of the frame of a vehicle near a wheel assembly which must be straightened. As shown, the vehicle may be mounted upon a frame machine or rack 100. Common frame machines 100 include a plurality of beams 102, and braces 104 which may be positioned at the desired points along the vehicle frame. A hydraulic or pneumatic cylinder 106 communicates with a hydraulic or pneumatic pump (not shown) through line 108. A chain 110 is secured between a beam 102 and an attachment point 111 on the vehicle frame. Slots or grooves 112 in beams 102 allow the braces 104 and the cylinders 106 to be positioned as desired. In the particular example of FIG. 17, cylinder 106 is extended which results in a force applied by chain 110 in force direction $F_1$. This results in a force being placed upon longitudinal frame member 114. A vertically extending and curved frame member 116, which is welded to longitudinal frame member 114 at attachment point 111, is also placed under stress by chain 110. The slide hammer 10 may then be used to apply the necessary force to bend frame members 114 and 116. As shown, slide hammer 10 is simply placed on the opposite side of attachment point 111 and a force $F_2$ is applied by striking the plunger 14 against impact head 16.

Referring back to FIG. 7, the curved tip 82 can be further defined as having a flat shank 110 integral with a curved neck 114 which transitions from smaller to larger as it approaches the working end 112. End 112 is blunted. Thus, the removable tip of FIG. 7 is able to impart an angular force with respect to the orientation of the slide hammer.

Referring back to FIG. 8, this chisel-type tip 84 can be further defined as including a body or block portion 118 with a pair of converging side walls 120 forming the working end 121. A notch 122 may be cut out of the working end 121. The removable tip illustrated in FIG. 8 is especially adapted for separating two pieces of joined metal. The working end 121 is inserted between the pieces to be separated. The converging side walls 120 separate the two pieces as the working end is driven between the pieces.

Referring back to FIG. 9, the rubber, mallet-type tip 86 can be further defined as including a semi-spherical converging portion 126 terminating in a flat or slightly rounded working end 127.

Referring back to FIG. 10, the rod-like tips 88 and 89 can be further defined as including elongate shafts 130 and 131, respectively, and including serrated or waffle-like working ends 132 and 135 which extend transversely to the shafts 130 and 131. As also shown, rod-like tips 88 and 89 are of different lengths and diameters, and are interchangeable by connection to threaded end 133 of receiving section 49. Thus, it is contemplated within the spirit and scope of this invention that the removable tips themselves can have removable sections. Thus, the shafts 130 and 131 can be defined as removable sections within the tips 88 and 89.

The removable tip shown in FIG. 10 is especially adapted for use in applying a force to a difficult to reach location, particularly on the frame of a vehicle. For example, access ports are provided on the frame rail of a vehicle in order that a dent or kink in the rail can be accessed in the event the rail is damaged. Consequently, the small diametered shaft 130 is inserted through the particular access port enabling the working end 132 to contact the damaged area of the frame rail.

The removable tip shown in FIG. 11 is also especially adapted for accessing difficult to reach locations, for example, on the frame of a vehicle. Typically, tubing or hose extends along certain portions of the frame rail, such as brake lines and the like. In order to avoid damaging those elements, it is necessary to have an extension which may reach around a comer, or otherwise allow a force to be applied by the slide hammer which is not necessarily directly in line with the axis of the slide hammer. Accordingly, the removable tip of FIG. 11 may be used to access difficult to reach locations where the extension 99 is provided to apply the desired force at a location offset from the axis of the slide hammer.

Referring back to FIG. 12, the blunted, chisel-type tip 92 can be further defined as including a shank 134 having substantially flat opposed sides, and a blunted rubber working end 136. The shank 134 progressively enlarges as it approaches the rubber working end 136.

Referring back to FIG. 13, the spatula shaped tip 93 can be further defined as including a shank 140 having substantially flat opposed sides, and a substantially flat working end 142 extending transversely to the shank 140.

Referring back to FIG. 14, the circular waffle-type tip 94 can be further defined as including a cylindrical shaft 144 and a waffle or serrated working end 146 extending transversely to the shaft 144.

Referring back to FIG. 15, the hook-type tip 96 can be further defined as including a guide or supporting shank 148 which connects along the length of receiving section 49, a bend 150, and a reverse extending flange 152. This type of tip is ideal for straightening a twisted or bent frame of a vehicle. In use, a flange or channel of the frame at or near the twist/bend is inserted in the gap between supporting shank 148 and reverse extending flange 152. As force is applied to the slide hammer, the flange or channel of the frame remains captured between shank 148 and flange 152. Accordingly, the frame can be forced back to its original shape and orientation.

Referring back to FIG. 16, this tip is ideally suited for having the capability to apply force at a multitude of different angles, and also to provide an impact surface which grips or hold the impacted surface. As shown, the tip 98 includes a plurality of irregular shaped surfaces, shown as surfaces 216, 218, and 220. The cooperating arrangement of surfaces 216 enables force to be applied against a comer or protruding flange, such as on the frame of vehicle. The cooperating arrangement of surfaces 218 enables force to be applied against a rounded or cylindrical shaped object. Surface 220 is ideally suited for holding a smaller channel or protruding element to be contacted. Those skilled in the art can envision other specific uses for the arrangement shown in FIG. 16.

Figure 18:
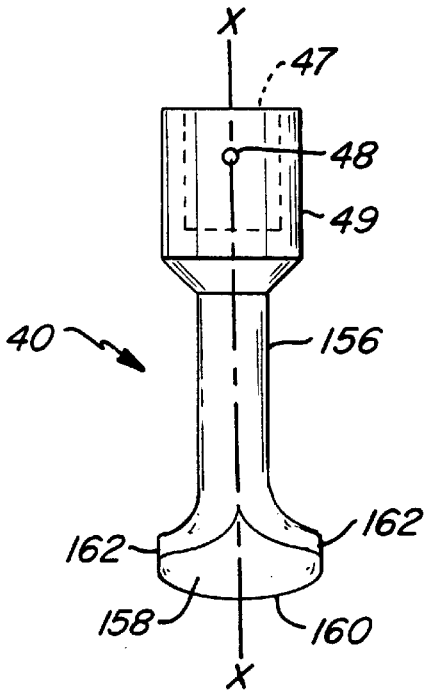
FIG. 18 is an enlarged plan view of another type of tip which may be used with the slide hammer.
Figure 19:
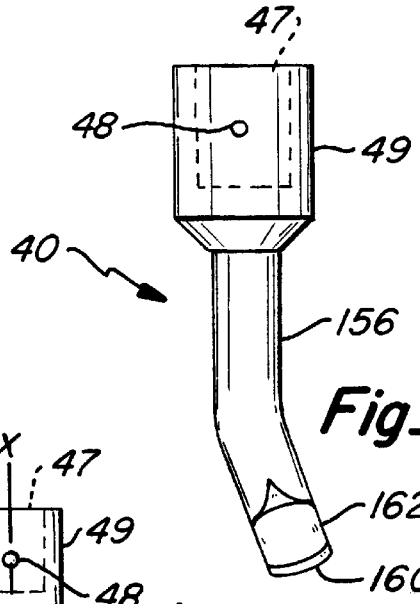
FIG. 19 is a side view of FIG. 18.

FIGS. 18–27 illustrate a number of additional types of tips 40 which may be used with the slide hammer of this invention. Beginning first with FIG. 18, this tip can be described as a curved shaft flared chisel. As shown, the shaft 156 extends away from the receiving section 49. An enlarged transverse portion 158 is formed near the working end 160. FIG. 18 is a plan view of this particular removable tip. FIG. 19 is a side view of the tip of FIG. 18 which illustrates that the shank 156 is bent a desired angle. Side edges 162 are substantially flat and extend along the axis X—X.

Figure 20:
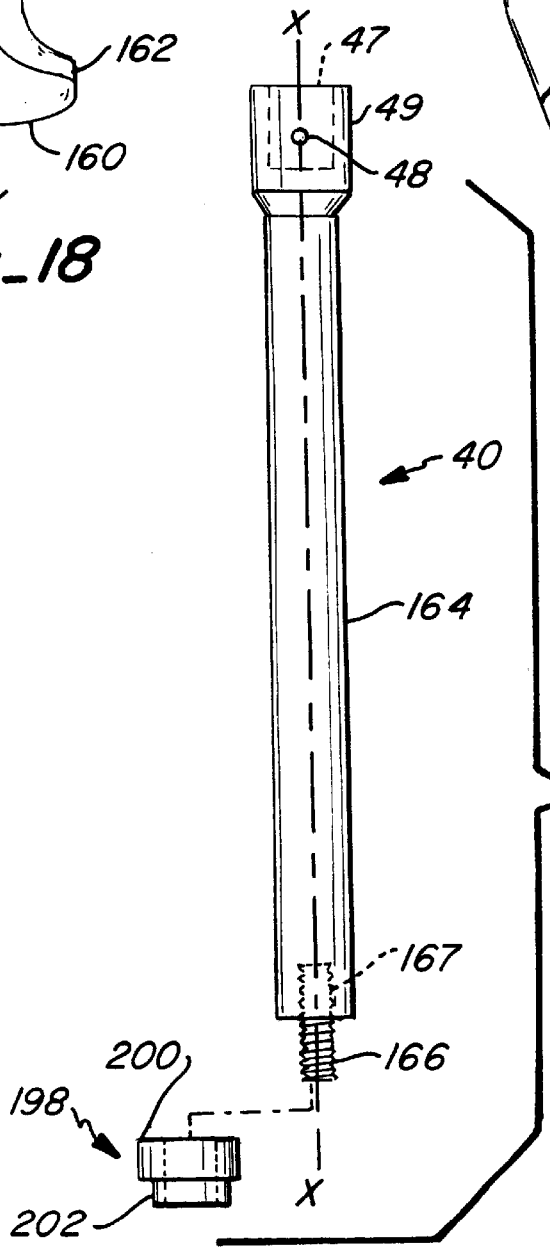
FIGS. 20–25 are enlarged plan views of additional types of tips which may be used with the slide hammer.

FIG. 20 illustrates yet another example of a removable tip which is especially adapted for a particular purpose, namely, for driving cam bearings in the camshaft of a vehicle. As shown, this removable tip includes an elongate shaft 164 with a threaded rod 166 secured within a threaded well 167. The free or distal end of threaded rod 166 is then inserted into a driving implement which directly contacts the cam bearing of a camshaft. As shown, the driving implement can be in the form of a plug 198 having a metallic or steel plate 200 and a rubber impact section 202. In use, the plug 198 is slipped over the threaded rod 166. The threaded rod is then inserted within a threaded well of the camshaft adjacent the cam bearing to be driven. The threaded rod is screwed tightly against the threaded well within the camshaft which compresses and flattens out the rubber impact section 202 positioned inside the race of the cam bearing. The plate 200 contacts the race of the bearing which enables the cam bearing to be manipulated by the force of the slide hammer.

Figure 21:
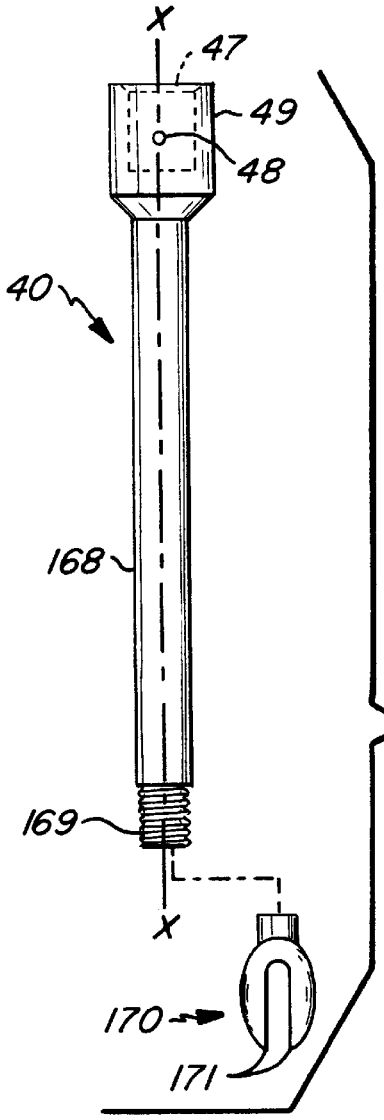

FIG. 21 illustrates yet another removable tip which is especially adapted for a particular purpose, namely, removing ball joints from the control rod of a vehicle. As shown, this removable tip includes a shaft 168, and a threaded distal end 169. A driving implement in the form of a fork 170 attaches to the threaded end 169. The fork 170 includes a pair of forked ends 171. In operation, the fork ends 171 are inserted over the ball joint of the vehicle. The ball joint is removed from the control arm when force is imparted on the fork 170 from the slide hammer.

Figure 22:
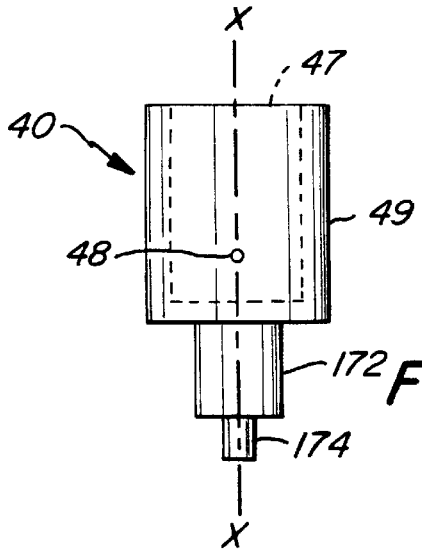

Yet another type of removable tip is shown in FIG. 22. This removable tip is ideally suited for driving bushings. As shown, this removable tip includes a cylindrical shank 172 and a smaller diametered working end 174. End 174 is sized to match the bushing to be removed/separated.

Figure 23:
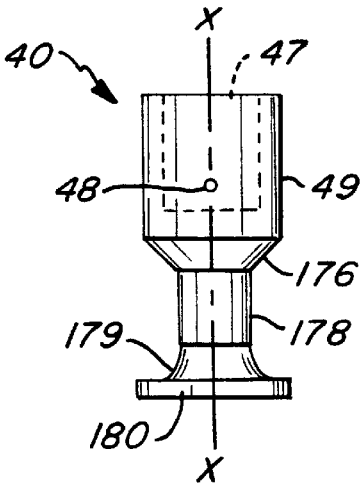

FIG. 23 illustrates yet another type of removable tip. This tip can be generally described as a shrinking round hammer end. As shown, this removable tip includes a converging neck 176, a straight shank 178, a diverging section 179, and a round shaped working end 180 with a flat impact face.

Figure 24:
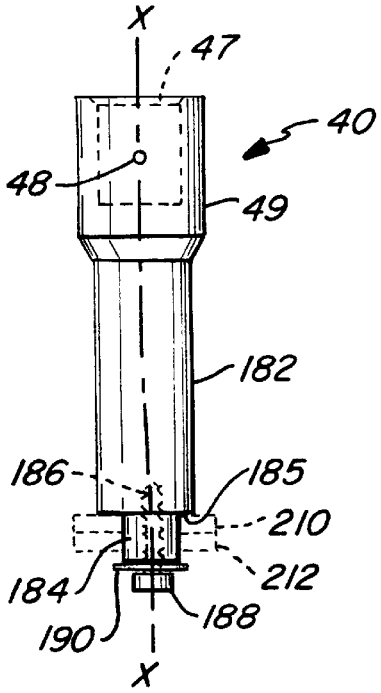

FIG. 24 illustrates yet another type of removable tip which is ideally suited for a particular purpose, namely, for driving a bushing and grease seal on the wheel of a vehicle. As shown, this removable tip includes a shaft 182, an extension 184, a securing washer 190, and a securing nut 188. A threaded rod/bolt 186 extends interiorly through extension 184 and partially into shaft 182. In operation, a circular sizing plate 210 having a central opening is slipped over extension 184, and rests against ledge 185. A matching sized grease seal 212 is then slipped over extension 184 against sizing plate 210. The purpose of securing nut 188 and securing washer 190 is simply to keep the sizing plate 210 attached to the removable tip. Of course, the diameter of the opening in grease seal 212 is large enough to slip over the securing washer 190. As needed, the sizing plate 210 is replaced with a sizing plate matching the particular sized grease seal. Because the slide hammer may apply a precisely aligned force against the removable tip shown in FIG. 24, the grease seal 212 may be placed within the wheel assembly without damage. As well understood by those skilled in the art, pounding in the grease seal 212 on a wheel assembly can result in damage to the grease seal if the grease seal is not precisely aligned when emplaced. With the slide hammer of this invention, the grease seal may be emplaced without damage because the slide hammer has the capability to impart an exact amount and direction of force.

Figure 25:
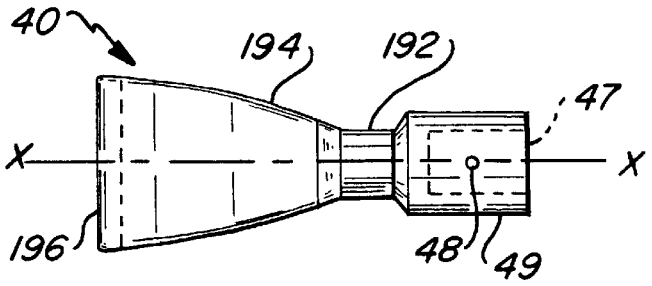
Figure 26:
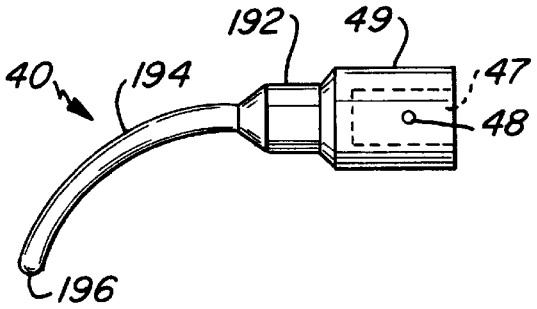
FIG. 26 is a side view of the tip illustrated in FIG. 25.

FIG. 25 is yet another example of a removable tip which may be used in conjunction with the slide hammer of this invention. As shown, this removable tip includes a neck 192, a diverging shank with substantially flat opposed sides 194, and a blunted working end 196. As shown in FIG. 26, the diverging shank 194 is also bent at an angle. Thus, like the tip shown in FIG. 7, force may be applied at the working end 196 in a direction which is different from the force applied by the slide hammer.

Figure 27:
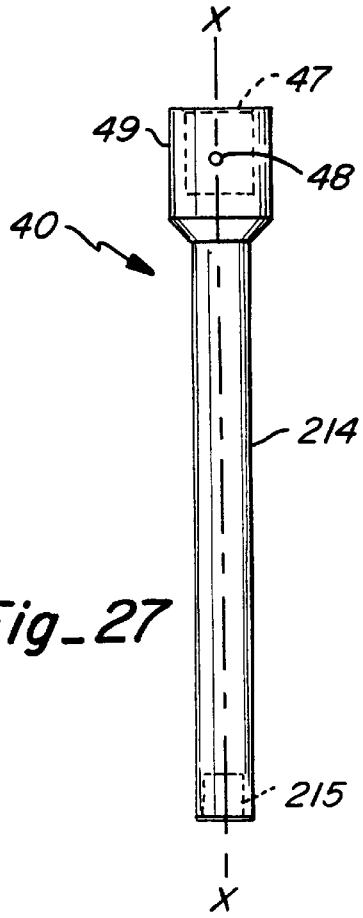
FIG. 27 is another enlarged plan view of another tip which be used with the slide hammer.

FIG. 27 illustrates yet another example of a removable tip which may be used in conjunction with the slide hammer. As shown in this figure, this removable tip includes an elongate shaft or shank 214. The distal end of the shaft 214 includes a cylindrical shaped well or opening 215. This well or opening 215 is especially adapted for driving roll pins which may be used to secure an implement. For example, roll pins are used to connect track sections in a tracked vehicle, as well as replacement tips for construction equipment, like the replaceable tips used on the jaws of a bucket loader. In operation, the roll pin to be installed would have one end inserted within the well 215. The other end of the roll pin would be placed into/against the opening into which it is to be driven. The slide hammer could then impart a directed force to insert the one end of the roll pin into the opening. Then, the roll pin can be removed within the well 215 and the remaining length of the roll pin could be pounded into place. For the FIGS. 18, 20–25, and 27–28 discussed immediately above, axis X—X is also shown to better visualize the particular removable tip. In each case, the removable tip is symmetrical about the axis X—X.

Figure 28:
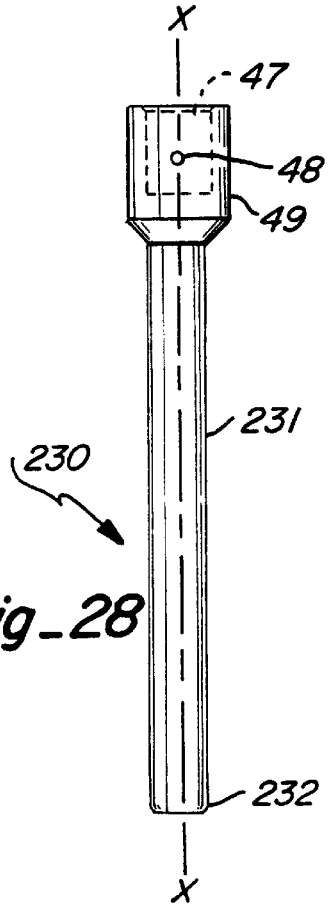
FIG. 28 illustrates in plan view an extension which may be used as an attachment to the impact head of the slide hammer.

FIG. 28 illustrates an extension which may be attached to the impact head. As shown, the extension 230 includes an extension shaft 231, and a distal end 232 which is in the same shape and dimension as the distal end of the impact head. Accordingly, a removable tip would then be attached to the distal end 232 enabling the user to be able to further reach to a desired point of impact.

Figure 29:
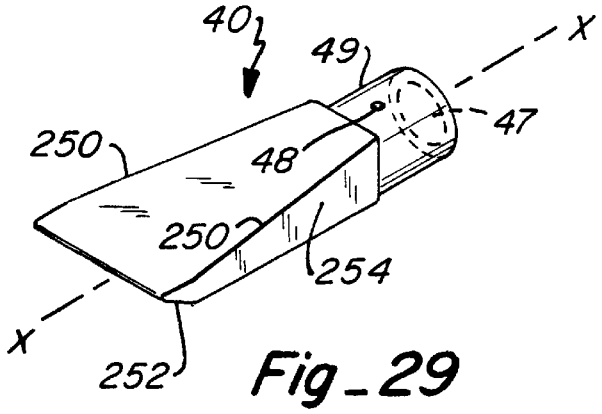
FIGS. 29–32 illustrate yet additional types of tips which may be used with the slide hammer.

FIG. 29 illustrates another removable tip that may be used in conjunction with the slide hammer. This particular tip is characterized by a diverging shank 250, and a narrowing side edge 254 which progressively narrows toward the beveled tip 252. This particular removable tip is advantageous for use in connection with scraping floor tile and other hard to remove materials from flat surfaces.

Figure 30:
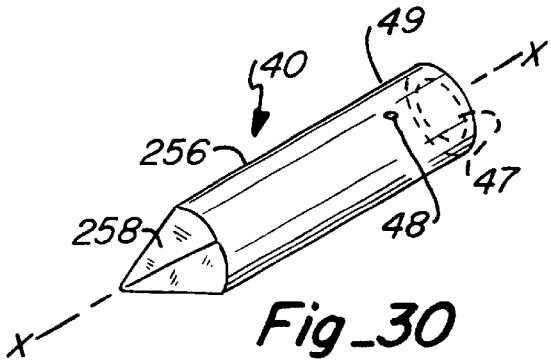

FIG. 30 shows another removable tip which is characterized by a cylindrical shank 256 having a pyramid shaped tip 258. The tip 258 may be three-sided, or could have yet additional sides which converge to form a point at the distal tip. This removable tip is particularly adapted for breaking apart concrete slabs, brick, mortar, and other stone materials.

Figure 31:
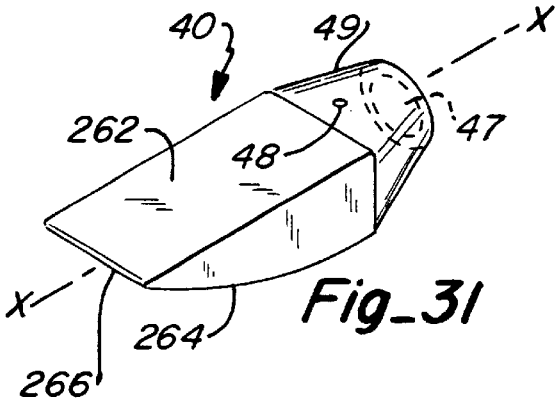
Figure 32:
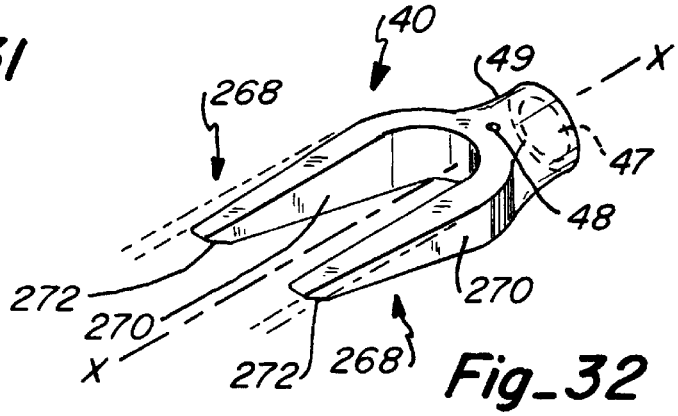

FIG. 31 illustrates another removable tip which is characterized by a parallel extending surface and an intersecting sloping side 264. Accordingly, a pointed tip or edge 266 extends along the transverse width of surface 262. As with the tip shown in FIG. 30, this removable tip is also well suited for breaking apart concrete, brick and other stone materials. FIG. 32 illustrates one last example of a removable tip which may be used in conjunction with the slide hammer. This removable tip is characterized by a pair of extensions 268 which form a forked end, the extensions extending substantially parallel to one another. Each of the extensions 268 has a narrowing side edge 270 which narrows towards the respective beveled tip 272. This particular removable tip has many contemplated uses to include prying and scraping. Additionally, the forked arrangement allows a user to impart a force on both sides of an object which is placed between the extensions 268.

This invention has been described in detail with reference to a particular embodiment thereof, but it will be understood that various other modifications can be effected within the spirit and scope of this invention.

What is claimed is:

1. A slide hammer comprising:

a guide sleeve having a distal end and a proximal end, said guide sleeve further having an inner surface defining a longitudinal passageway therein, and a distal stop positioned at said distal end;

an impact head slidably secured within said longitudinal passageway of said guide sleeve, said impact head having a proximal end which remains within said longitudinal passageway, and a distal end including an impact extension which extends beyond said distal end of said guide sleeve, said impact head being movable between an extended position and a retracted position, the extended position being limited by said distal stop of said guide sleeve;

a plunger inserted through said proximal end of said guide sleeve and into said longitudinal passageway, said plunger having a proximal end which extends proximally beyond said proximal end of said guide sleeve, said guide sleeve and said plunger extending along a longitudinal axis of said slide hammer, said plunger being slidable within said longitudinal passageway for selective contact with said proximal end of said impact head, wherein the contact between said plunger and said impact head result in a force transmitted to said distal end of said impact head; and a proximal stop formed in said guide sleeve which limits the proximal travel of said impact head within said longitudinal passageway, and defmes the limit of the retracted position;

a removable tip attached to said distal end of said impact head, said removable tip including a shank having diverging sides as said shank extends in a distal direction away from said impact head, said shank further having a thickness which converges as said shank extends in the distal direction.

2. A slide hammer comprising:

a guide sleeve having a distal end and a proximal end, said guide sleeve further having an inner surface defining a longitudinal passageway therein, and a distal stop positioned at said distal end;

an impact head slidably secured within said longitudinal passageway of said guide sleeve, said impact head having a proximal end which remains within said longitudinal passageway, and a distal end including an impact extension which extends beyond said distal end of said guide sleeve, said impact head being movable between an extended position and a retracted position, the extended position being limited by said distal stop of said guide sleeve;

a plunger inserted through said proximal end of said guide sleeve and into said longitudinal passageway, said plunger having a proximal end which extends proximally beyond said proximal end of said guide sleeve, said guide sleeve and said plunger extending along a longitudinal axis of said slide hammer, said plunger being slidable within said longitudinal passageway for selective contact with said proximal end of said impact head, wherein the contact between said plunger and said impact head result in a force transmitted to said distal of said impact head; and a proximal stop formed in said guide sleeve which limits the proximal travel of said impact head within said longitudinal passageway, and defines the limit of the retracted position;

a removable tip attached to said distal end of said impact head, said removable tip including a cylindrical shaped shank having a distal end, and at least three surfaces extending from the distal end, and said at least three surfaces converging towards one another as the surfaces extend distally from the distal end.

3. A slide hammer comprising:

a guide sleeve having a distal end and a proximal end, said guide sleeve further having an inner surface defining a longitudinal passageway therein, and a distal stop positioned at said distal end;

an impact head slidably secured within said longitudinal passageway of said guide sleeve, said impact head having a proximal end which remains within said longitudinal passageway, and a distal end including an impact extension which extends beyond said distal end of said guide sleeve, said impact head being movable between an extended position and a retracted position, the extended position being limited by said distal stop of said guide sleeve;

a plunger inserted through said proximal end of said guide sleeve and into said longitudinal passageway, said plunger having a proximal end which extends proximally beyond said proximal end of said guide sleeve, said guide sleeve and said plunger extending along a longitudinal axis of said slide hammer, said plunger being slidable within said longitudinal passageway for selective contact with said proximal end of said impact head, wherein the contact between said plunger and said impact head result in a force transmitted to said distal of said impact head; and a proximal stop formed in said guide sleeve which limits the proximal travel of said impact head within said longitudinal passageway, and defines the limit of the retracted position;

a removable tip attached to said distal end of said impact head, said removable tip including a pair of side edges extending substantially parallel to one another and terminating at a distal end of said removable tip, and a sloping surface intersecting said distal end of said removable tip.

4. A slide hammer comprising:

a guide sleeve having a distal end and a proximal end, said guide sleeve further having an inner surface defining a longitudinal passageway therein, and a distal stop positioned at said distal end;

an impact head slidably secured within said longitudinal passageway of said guide sleeve, said impact head having a proximal end which remains within said longitudinal passageway, and a distal end including an impact extension which extends beyond said distal end of said guide sleeve, said impact head being movable between an extended position and a retracted position, the extended position being limited by said distal stop of said guide sleeve;

a plunger inserted through said proximal end of said guide sleeve and into said longitudinal passageway, said plunger having a proximal end which extends proximally beyond said proximal end of said guide sleeve, said guide sleeve and said plunger extending along a longitudinal axis of said slide hammer, said plunger being slidable within said longitudinal passageway for selective contact with said proximal end of said impact head, wherein the contact between said plunger and said impact head result in a force transmitted to said distal of said impact head; and a proximal stop formed in said guide sleeve which limits the proximal travel of said impact head within said longitudinal passageway, and defines the limit of the retracted position;

a removable tip attached to said distal end of said impact head, said removable tip including a pair of extensions extending distally from said impact extension, each extension of said pair of extensions having a thickness which converges as said extensions extend distally from said impact extension.

5. A slide hammer comprising:

a guide sleeve having a distal end and a proximal end, said guide sleeve further having an inner surface defining a longitudinal passageway therein, and a distal stop positioned at said distal end;

an impact head slidably secured within said longitudinal passageway at said distal end of said guide sleeve, said impact head having a proximal end which remains within said longitudinal passageway, and a distal end including an impact extension which extends beyond said distal end of said guide sleeve, said impact head being movable between an extended position and a retracted position, the extended position being limited by said distal stop of said guide sleeve;

a plunger inserted through said proximal end of said guide sleeve and into said longitudinal passageway, said plunger having a proximal end which extends proximally beyond said proximal end of said guide sleeve, said plunger being slidable within said longitudinal passageway for selective contact with said proximal end of said impact head;

said proximal end of said impact head includes a slide portion which is positioned in close contact with said inner surface;

a proximal stop formed within said guide sleeve which limits the proximal travel of said impact head within said longitudinal passageway, and defines the limit of the retracted position;

a tip member removably attached to said impact extension; and wherein the contact between said plunger and said impact head results in a force transmitted to a targeted object in contact with said distal end of said impact head.

* * * * *

UNITED STATES PATENT AND TRADEMARK OFFICE

CERTIFICATE OF CORRECTION

PATENT NO. : 6,474,198 B2
DATED : November 5, 2002
INVENTOR(S) : Lowther

It is certified that error appears in the above-identified patent and that said Letters Patent is hereby corrected as shown below:

Column 11,
Line 40, “defmes” should read -- defines --.

Signed and Sealed this

Twenty-fifth Day of February, 2003

JAMES E. ROGAN
*Director of the United States Patent and Trademark Office*